United States Patent [19]

Martin

[11] Patent Number: 4,691,563

[45] Date of Patent: Sep. 8, 1987

[54] RAILROAD COUPLER MOUNT

[75] Inventor: Gregory C. Martin, Gaithersburg, Md.

[73] Assignee: Pulse Electronics, Inc., Rockville, Md.

[21] Appl. No.: 934,922

[22] Filed: Nov. 25, 1986

[51] Int. Cl.[4] ..... G01L 5/00; G01L 5/28

[52] U.S. Cl. ..... 73/129; 246/167 R

[58] Field of Search ..... 213/1 R, 100 R, 103, 213/105, 100 W, 126, 127, 128, 129, 135, 136, 75 R, 76, 77; 246/167 R, 166; 73/129; 248/231.4

[56] References Cited

U.S. PATENT DOCUMENTS

| | | | |
|---|---|---|---|
| 165,426 | 7/1875 | Ray et al. | 362/61 |
| 1,363,098 | 12/1920 | Dysart et al. | 362/61 |
| 1,716,546 | 6/1929 | Fry | 362/61 |
| 1,738,016 | 12/1929 | Pehrson | 116/30 |
| 2,355,544 | 8/1944 | McGowan | 116/30 |
| 3,025,973 | 3/1962 | Shafer | 213/1 R |
| 3,438,511 | 4/1969 | Cope | 213/76 |
| 3,587,868 | 6/1971 | Yates | 213/1 R |
| 4,487,060 | 12/1984 | Pomeroy | 246/169 R |
| 4,520,662 | 6/1985 | Schmid | 213/75 R |
| 4,592,217 | 6/1986 | Fernandez et al. | 246/167 R |

FOREIGN PATENT DOCUMENTS 891312 3/1944 France .

*Primary Examiner*—Randolph A. Reese
*Assistant Examiner*—Charles Barrett
*Attorney, Agent, or Firm*—C. Lamont Whitham

[57] ABSTRACT

An improved railroad coupler mount is provided for securely mounting railroad signalling and monitoring equipment (10) on the coupler of the last railroad car of a train. The railroad coupler mount includes a banana shape member (30) which extends through a pair of relief holes (22) in the knuckle (12) of the railroad car coupler. The railroad coupler mount has a tightening means (28) for partially withdrawing the banana shaped member and tightly pressing a support leg (20) against the side wall of the coupler to provide a secure mount which is free of rotation problems. The railroad coupler mount is secured with a locking device (26) which serves the dual function of resisting the total withdrawal of the banana shaped member when the railroad coupler mount is tightened as well as preventing the unauthorized removal of the signalling and monitoring equipment. The railroad coupler mount is attached in a position which avoids damage to the signalling and monitoring equipment due to accidental coupling.

9 Claims, 5 Drawing Figures

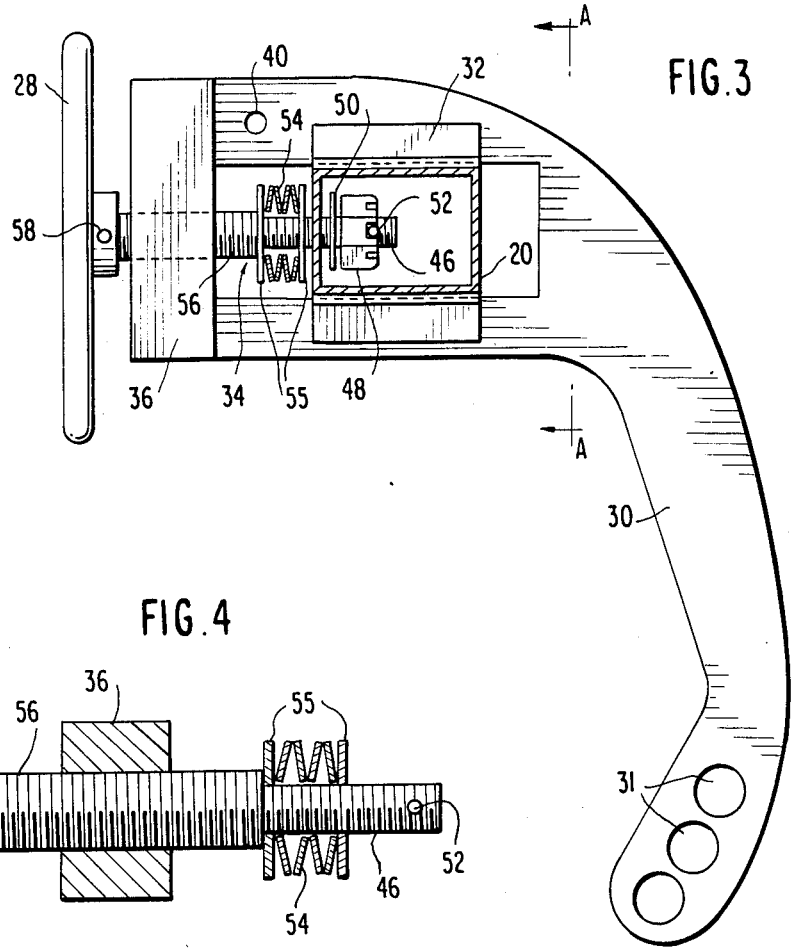
FIG.3
FIG.4
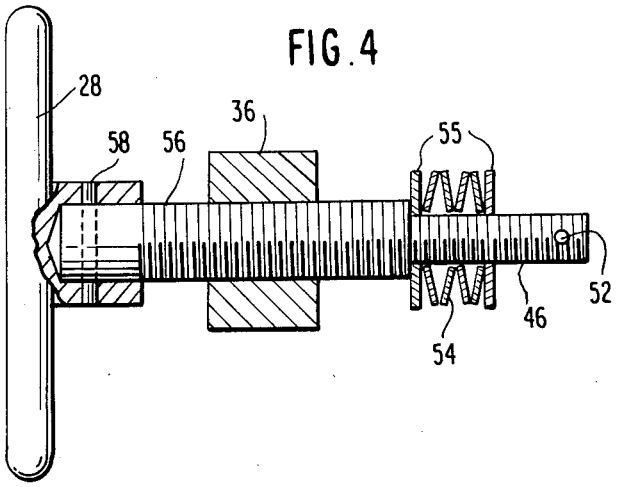
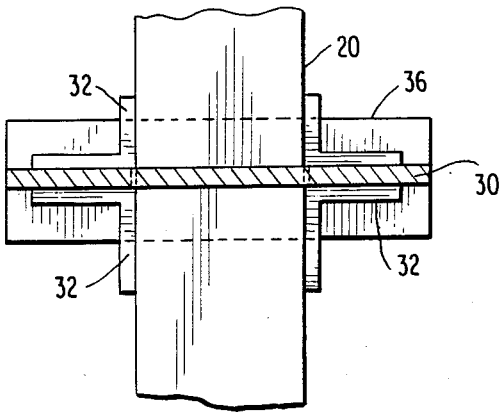
FIG.5

RAILROAD COUPLER MOUNT

BACKGROUND OF THE INVENTION

1. Field of the Invention

This invention is generally directed to an apparatus for mounting marker light and telemetry equipment to railroad cars, and more particularly, to a coupler mount assembly which secures equipment to the coupling knuckle of the last car in a train.

2. Description of the Prior Art

In recent years there has been a trend toward the use of end of train signalling and monitoring equipment, in place of cabooses, to meet operating and safety requirements. The information monitored typically includes the air pressure of the brake line, battery condition, light operation, and train movement. The information is transmitted to the crew in the locomotive by a battery powered telemetry transmitter. In addition, a marker light is required at the end of the train. The light must be mounted a specific height above the track and have a well defined beam pattern.

Railroad signalling and safety equipment of various kinds has been used extensively for years. Early examples are shown in the following U.S. patents: U.S. Pat. No. 165,426 to Ray et al, U.S. Pat. No. 1,363,098 to Dysart et al, U.S. Pat. No. 1,716,546 to Fry, and U.S. Pat. No. 1,738,016. More recent examples of attaching equipment to the end of a train are shown in the following U.S. patents: U.S. Pat. No. 2,355,544 to McGowan, U.S. Pat. No. 3,025,973 to Shafer, U.S. Pat. No. 3,587,868 to Yates, U.S. Pat. No. 4,487,060 to Pomeroy, U.S. Pat. No. 4,520,662 to Schmid, and U.S. Pat. No. 4,592,217 to Fernandez et al. Examples of signalling equipment shown in foreign patents include: French Pat. No. 891,312 and Russian Pat. No. 262,935.

The patent to McGowan shows signalling equipment attached to the rear coupler of a train, and specifically shows the equipment secured to the caboose. The attaching means is arranged so that when the equipment is attached, the attaching means renders the car coupler incapable of mating with another car coupler. The patent to Pomeroy shows a monitoring and transmitting unit attached to the knuckle of the coupler of the last car of a train, with the equipment extending into the coupler opening.

It has been recognized that equipment mounted at the rear of a train, particularly equipment mounted on the coupler of the last car should be mounted in a manner which protects the equipment from damage. As cars are moved around in a yard, an operator may forget that a car has equipment mounted to the coupler and therefore ruin the equipment when attempting to join cars which have equipment mounted inside the coupler. Also, a pusher locomotive cannot be attached with equipment inside the coupler. The patent to Fernandez et al avoids these problems with a marker attachment which is secured on top of the railroad car coupler utilizing the flag hole. The patents to Shafer, Yates, and Schmid attach the end of train equipment to the side of the coupler to avoid damage.

The Schmid patent is directed to a coupler mount assembly particularly adapted to mounting an end of train telemetry package to the trailing coupler of the last car of a railroad train. This coupler mount assembly makes use of the four relief holes in the side of a coupler, these relief holes being provided to facilitate the casting of the coupler and to lighten the coupler. The Schmid coupler mount has a set of jaw members including upper and lower parallel hooks. The coupler mount is installed on a coupler by inserting the hooks into the relief holes and drawing the jaw members together by rotation of a rod. The Yates patent is directed to a hose hanger arrangement which makes use of the four relief holes in the coupler of a railroad car. A pair of hooked shaped members are inserted through the core openings or relief holes of a coupler so that the hooks overlap the vertical wall portion of the coupler. The hanger is secured to the coupler by insertion of a bolt through a bored boss in the coupler and a hole in a bracket on the hanger assembly. The hose is supported at a position below the coupler. The Shafer patent is directed to a car coupler shield which makes use of the four relief holes in a car coupler. The shield protects automatic couplers from the adverse conditions which prevail in steel mills that are not encountered in normal railroad usage. Molten metal and other material is prevented from fusing the couplers together by the splash shield deflecting the slag away from the couplers. A pair of hooked shaped members are inserted through the relief holes of the coupler and secured by a pin that is received by holes in the projecting ends of the hooked shaped members. The shield requires a supporting member opposite from its leg member to provide stability of the shield and preclude rotation of the shield about the leg member.

Signalling and monitoring equipment must be easily removable and replaceable to allow efficient use in a train yard and it must be provided with a means to prevent accidental damage or unauthorized removal. The device disclosed in the Schmid patent is expensive to manufacture and is difficult for one man to mount on the railroad car coupler. The devices shown in the Yates patent and the Shafer patent could not be adapted to meet train operating and safety requirements. The device in the Yates patent could not be properly attached to couplers which do not have a bored boss in the coupler. The device in the Shafer patent relies on a supporting member to provide stability and to preclude rotation about the leg member. The supporting member would be inadequate for securing signalling and monitoring equipment to a railroad car coupler.

The disadvantages of the prior art are overcome by this railroad coupler mount. It has a simple, lightweight construction which easy to install and remove. The coupler mount mates with a telemetry package to form an integral, modular package which is easily disassembled. The coupler mount provides a tightly secured telemetry package at a location where no damage by be caused by accidental coupling.

SUMMARY OF THE INVENTION

It is therefore an object of the present invention to provide an improved means for mounting end of train signalling and monitoring equipment to the coupling knuckle of a railroad car coupler in a manner that utilizes the relief holes present in the side walls.

It is another object of the invention to provide a mounting and attaching means for end of train equipment which is both secure and permits easy removal and replacement, while allowing yard operations to be carried out without the risk of damage to the equipment.

A further object of the invention is to provide an improved means of mounting end of train signalling and monitoring equipment which includes a banana shaped member that is tightened for a firm engagement with the coupler knuckle and does not require a supporting member to prevent rotation of the platform for the monitoring equipment.

A still further object of the invention is to utilize a banana shaped member which can be secured to the coupler knuckle without using a bored boss.

According to the invention, these and other advances over the prior art are achieved by a railroad car coupler mounting assembly which includes a banana shaped member that is inserted though one relief hole and projects out the corresponding relief hole on a common horizontal axis. The projecting end of the banana shaped member has an aperture through which a locking bar is received. The locking bar not only secures the mount to the coupler, it also prevents unauthorized removal from the coupler. The banana shaped member has a screw clamp arrangement at the base end which is used to draw the banana shaped member back out of the relief hole into which it is inserted, thereby drawing the mount tightly against the side wall of the coupler. The banana shaped member is moveable along guide members which are welded to a vertical leg that supports the equipment tray.

The coupler mount according to the invention may be combined with a sensor/transmitter unit which monitors several parameters of the train during operation. The sensor/transmitter unit is secured to a support tray carried by the coupler mount.

BRIEF DESCRIPTION OF THE DRAWINGS

The foregoing and other objects, aspects and advantages of the invention will be better understood from the following detailed description of a preferred embodiment with reference to the drawings, in which:

FIG. 3 is a plan view of the banana shaped member with base clamping means;

FIG. 4 is a plan view, partially in cross-section, of the clamping assembly used at the base end of the banana shaped member; and FIG. 5 is a section view of the banana shaped member taken along lines A—A in FIG. 3.

DETAILED DESCRIPTION OF THE PREFERRED EMBODIMENT OF THE INVENTION

Figure 1:
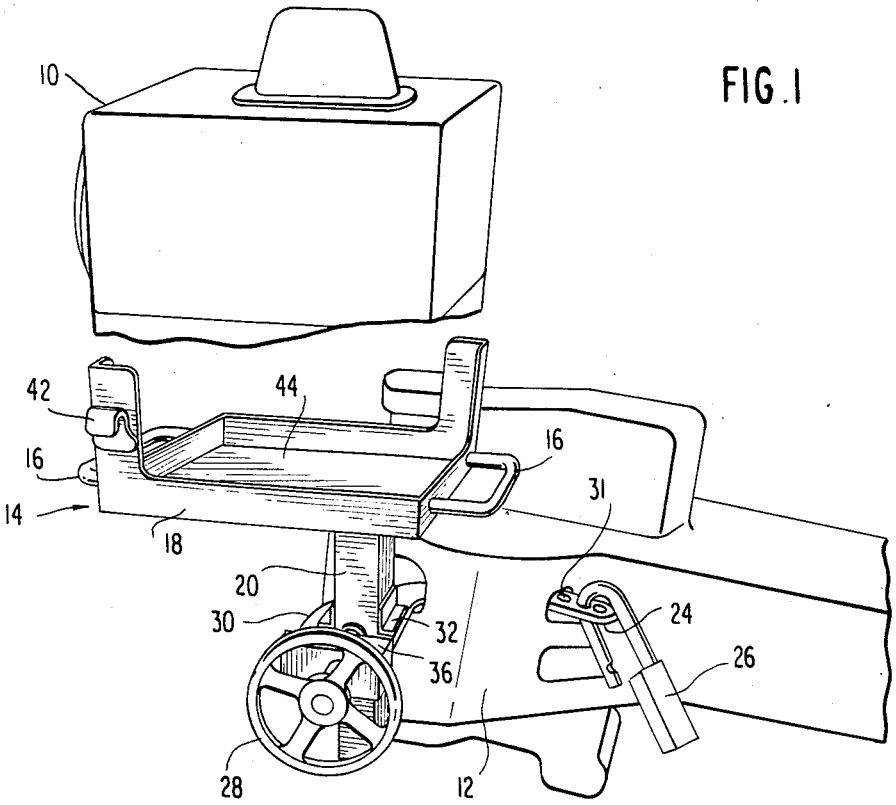
FIG. 1 is a pictorial view of the coupler mount assembly attached to a railroad car coupler.

In the drawings, like reference numerals indicate the same parts.

Figure 2:
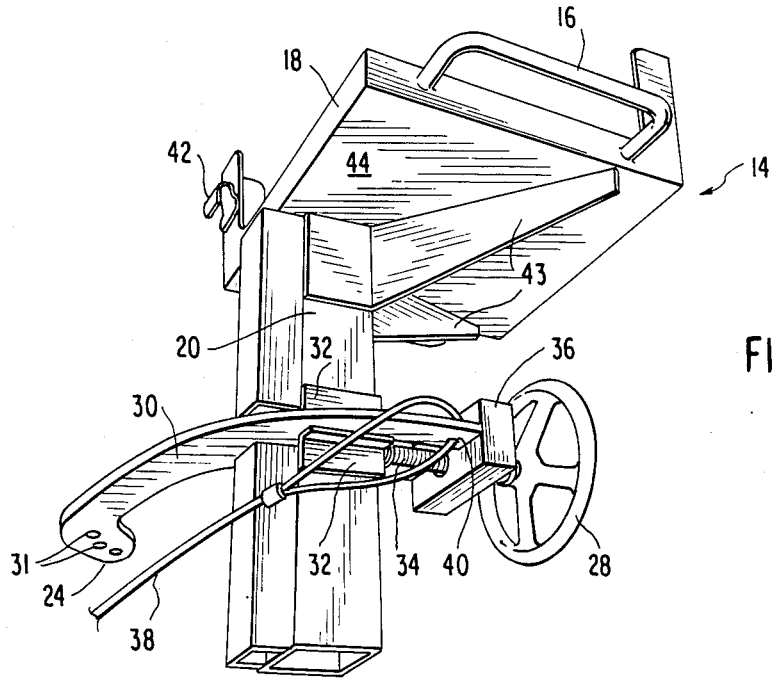
FIG. 2 is a perspective view of the coupler mount assembly.

Referring now to the drawings, and more particularly to FIG. 1, there is shown a battery pack with end of train signalling and monitoring equipment 10 attached to the coupler knuckle 12 of a railroad coupler by means of the coupler mount assembly 14 according to the invention. The mount assembly shown generally at 14 has handles 16 welded to the sidewall 18 of the equipment tray 44 (shown in FIG. 2) which are used for carrying the coupler mount with or without the signalling and monitoring equipment 10 attached. A vertical support leg 20 is welded or otherwise attached to the bottom of the equipment tray 44 and extends downward. At an intermediate level on the vertical support leg 20 a banana shaped member 30 (as best shown in FIGS. 2 and 3) attaches the mount assembly 14 to the knuckle 12 by extending through relief holes in the coupler. The projecting end 24 of the banana shaped member 30 is secured by locking member 26. Wheel 28 is used to tighten the mount assembly 14 to the side wall of the coupler knuckle 12.

As may be seen in FIG. 2, the banana shaped member 30 slides in guide members 32 as the screw 34 is adjusted by turning wheel 28. The vertical support leg 20 is slotted and guide members 32 are welded on either side of the slot to receive the banana shaped member 30. This is shown in more detail in FIG. 5 where the guide members 32 are welded on either side of the slotted supporting leg 20. The guide members 32 serve the purpose of guiding the banana shaped member 30 as it is adjusted.

Referring back to FIG. 2, hasps 42 are used for securing signalling and monitoring equipment to the mounting assembly 14. A safety cable 38 is attached through a hole 40 in the banana shaped member 30 close to the threaded follower block 36 for preventing the unauthorized removal of the signalling and monitoring equipment from the mounting assembly 14. Bracing members 43 are welded or otherwise attached to the bottom of the equipment tray 44 and the vertical support leg 20 to provide more stability.

As may be seen in FIGS. 3 and 4, the banana shaped member 30 has three apertures 31 in the projecting end 24 through which locking member 26 may extend. The locking member 26 serves the dual purpose of preventing unauthorized removal of the equipment and providing a brace against the knuckle for tightening purposes. Tightening is accomplished by drawing the banana shaped member 30 out of the relief hole 22 by rotating the wheel 28 so that the support leg 20 is forced against the coupler side wall. The screw 34 rotated by wheel 28 has two diameters; the smaller diameter 46 extends into the vertical supporting leg 20. A slotted nut 48 and washer 50 are secured inside the vertical supporting leg 20 by a cotter pin 52 which extends though the smaller diameter 46 near the end of screw 34. A Belleville spring washer 54 is mounted outside the vertical supporting leg 20 on the smaller diameter 46. The Belleville washer 54 is a spring type washer and it is sandwiched between steel washers 55. The larger diameter 56 of screw 34 threadably passes through the follower block 36 and is connected to the wheel 28 by a pin 58.

In operation, the banana shaped member 30 is inserted through a relief hole in coupler knuckle 12 and projects out the corresponding relief hole on a common horizontal axis. A locking member 26 is secured through an appropriate aperture 31 in the projecting end 24. The wheel 28 is turned to partially withdraw the banana shaped member 30 and force the support leg 20 against the sidewall of the coupler. The Belleville washer 54 is compressed against the support leg 20 and the shoulder between large diameter 56 and small diameter 46 sections of screw 34.

The coupler mount is of simple, lightweight construction. It is easy to install and remove from the railroad car coupler. The telemetry package is tightly secured to the coupler at a location where no damage would be caused by accidental coupling. Although a preferred embodiment of the invention has been described, those skilled in the art will recognize that this invention may be practiced with modification to meet particular applications within the spirit and scope of the appended claims.

Having thus described my invention, what I claim as new and desire to secure by Letters Patent is as follows:

1. A railroad coupler mount for securing signalling and monitoring equipment to a knuckle of a railroad car coupler, comprising:

a banana shaped member which extends through a pair of relief holes on a common horizontal axis in said knuckle of said railroad car coupler, said banana shaped member having an end with an aperture to receive a bracing member;

support means for supporting said signalling and monitoring equipment and slidably receiving said banana shaped member at end opposite the apertured end; and tightening means for partially withdrawing said banana shaped member from said relief holes against the resistance of said bracing member to force said support means against a side wall of said railroad car coupler.

2. A railroad coupler mount as recited in claim 1, wherein said tightening means comprises:

a screw with a large diameter end and a small diameter end, said small diameter end being attached to said support means;

a follower block attached to said banana shaped member and which threadably engages said large diameter end of said screw; and turning means attached to said screw for rotating said screw and thereby laterally moving said follower block and the attached banana shaped member.

3. A railroad coupler mount as recited in claim 2, wherein there is a shoulder between the small and large diameter ends of said screw and further comprising a spring washer mounted on the small diameter end of said screw, said spring washer being compressed between said shoulder and said support means as said banana shaped member is withdrawn from said relief holes compressively forcing said support means against the sidewall of said railroad car coupler.

4. A railroad coupler mount as recited in claim 1, wherein said bracing member is a locking device to prevent unauthorized removal of said railroad coupler mount from a knuckle of a railroad car coupler.

5. A railroad coupler mount as recited in claim 1, wherein said support means comprises:

a vertical supporting leg;

a set of guide rails attached to said supporting leg for slidably receiving said banana shaped member; and an equipment tray attached to the top of said supporting leg.

6. A railroad coupler mount as recited in claim 5, wherein said tightening means comprises:

a screw with a large diameter end and a small diameter end, said small diameter end being attached to said vertical supporting leg;

a follower block attached to said banana shaped member and which threadably engages said large diameter end of said screw; and turning means attached to said screw for rotating said screw and thereby laterally moving said follower block and the attached banana shaped member.

7. A railroad coupler mount as recited in claim 5, further comprising:

a side wall around the periphery of said equipment tray, said sidewall mating with said signalling and monitoring equipment; and an attaching means integral with said side wall for attaching said signalling and monitoring equipment to said equipment tray.

8. A railroad coupler mount as recited in claim 7, further comprising a handle attached to said side wall of said equipment tray to aid in carrying and mounting said signalling and monitoring equipment attached to said equipment tray to said railroad car coupler.

9. A railroad coupler mount as recited in claim 8, further comprising means for securing said signaling and monitoring equipment to said railroad coupler mount to prevent unauthorized removal of said signalling and monitoring equipment from said railroad coupler mount.

* * * * *